US005081944A

United States Patent [19]

Nakanishi

[11] Patent Number: 5,081,944

[45] Date of Patent: Jan. 21, 1992

[54] WORK FABRIC FEEDING DEVICE FOR AUTOMATIC SEWING APPARATUS

[75] Inventor: Fumio Nakanishi, Suzuka, Japan

[73] Assignee: Brother Kogyo Kabushiki Kaisha, Nagoya, Japan

[21] Appl. No.: 669,024

[22] Filed: Mar. 13, 1991

[30] Foreign Application Priority Data

May 8, 1990 [JP] Japan ..... 2-119614

[51] Int. Cl.[5] ..... D05B 21/00

[52] U.S. Cl. ..... 112/121.12; 112/121.15

[58] Field of Search ..... 112/121.12, 121.15, 112/262.3, 265.1, 114, 104, 76, 103, 311, 121.11

[56] References Cited

U.S. PATENT DOCUMENTS

| | | | |
|---|---|---|---|
| 4,406,234 | 9/1983 | Johnson et al. | 112/121.15 |
| 4,462,320 | 7/1984 | Scholl | 112/104 |
| 4,497,266 | 2/1985 | Fujita et al. | 112/121.12 X |
| 4,506,612 | 3/1985 | Yanagi | 112/121.12 |
| 4,534,303 | 8/1985 | Off et al. | 112/121.15 X |
| 4,602,578 | 7/1986 | Yokoe et al. | 112/121.12 |
| 4,621,586 | 11/1986 | Binder | 112/121.12 |
| 5,000,103 | 3/1991 | Beerman | 112/121.15 X |

FOREIGN PATENT DOCUMENTS

| | | |
|---|---|---|
| 56-8640 | 2/1981 | Japan . |
| 63-46195 | 2/1988 | Japan . |

*Primary Examiner*—Werner H. Schroeder
*Assistant Examiner*—Paul C. Lewis
*Attorney, Agent, or Firm*—Oliff & Berridge

[57] ABSTRACT

A work fabric feeding device according to the present invention for use with an automatic sewing apparatus which includes a sewing machine having an arm extending in a first direction and a table which extends over a moving area of a work fabric to be sewn by the sewing machine comprises a beam extending in a second direction perpendicular to the first direction, guide rails for movably supporting the beam for movement in the first direction, a first moving mechanism for moving the beam in the first direction, a first movable frame movably supported for movement in the second direction by the beam, a second movable frame movably supported for movement in the second direction by the beam, a second moving mechanism to which the first movable frame and second movable frame are adjustably attached for movement in the second direction, the second moving mechanism moving the first movable frame and the second movable frame along the beam in the second direction, a work fabric holding frame capable of being placed on the table for holding a work fabric, a first lifting mechanism connected to the first movable frame and detachably connected to the work fabric holding frame, for lifting the work fabric holding frame and a second lifting mechanism connected to the second movable frame and detachably connected to the work fabric holding frame for lifting the work fabric holding frame.

22 Claims, 4 Drawing Sheets

WORK FABRIC FEEDING DEVICE FOR AUTOMATIC SEWING APPARATUS

BACKGROUND OF THE INVENTION

1. Field of the Invention

The present invention relates to a work fabric feeding device for an automatic sewing apparatus, and more particularly to a work fabric feeding device capable of moving a frame, for holding a work fabric, in an X-direction perpendicular to an arm of a sewing machine and in a Y-direction parallel to the arm of the sewing machine on a working table.

2. Description of the Related Art

Generally, an industrial automatic sewing apparatus includes a sewing machine for forming stitches and a work fabric feeding device for feeding a work fabric to a desired position so that any part of the work fabric may be sewn by the sewing machine. The work fabric feeding device is provided with a frame for holding the work fabric, an X-direction driving mechanism for moving the work fabric holding frame on a working table in an X-direction perpendicular to an arm of the sewing machine, and a Y-direction driving mechanism for moving the work fabric holding frame in a Y-direction perpendicular to the X-direction.

A work fabric feeding device having a feeding device movable in an X-direction and in a Y-direction, and a work fabric holding device fixed on the feeding device is disclosed in Japanese Patent Publication No. 56-8640. The work fabric holding device has a pair of work fabric holding units. Each of the work fabric holding units includes a work fabric holding frame having a lower plate and an upper plate placed on the lower plate, and a lifting device for lifting the upper plate. A work fabric is set on the lower plates when the upper plates of the work fabric holding units are lifted by the lifting devices. After that, the upper plates are lowered by the lifting devices, so that the work fabric is held between the upper plates and the lower plates. Two long slots parallel to an X-direction are formed, one on one end portion of each of the lower plates of the work fabric holding units. The work fabric holding units are fixed to the feeding device by screws inserted into the long slots of the lower plates. The positions where the work fabric holding units are fixed to the feeding device can be adjusted in the X-direction by loosening screws.

Accordingly, the work fabric holding device can hold work fabric having various sizes by adjusting the positions where the work fabric holding units are fixed to the feeding device.

In the above mentioned work fabric feeding device, the position where each work fabric holding unit is fixed to the feeding device can be only adjusted within a predetermined area corresponding to the length of the long slots formed on the lower plate. Therefore, in the situation where the size of a work fabric is changed to extend beyond the predetermined area, the work fabric holding frame having the lower plate and the upper plate has to be changed for another work fabric holding frame which is more suitable for the size of the work fabric. However, it is impossible to exchange only the work fabric holding frame for another work fabric holding frame in the device of Japanese Patent Publication No. 56-8640 because the lifting device is fixed to the work fabric holding frame. Accordingly, a pair of work fabric holding units including the work fabric holding frame and the lifting device have to be entirely exchanged for another pair of work fabric holding units.

OBJECTS AND SUMMARY OF THE INVENTION

An object of the present invention is to provide a work fabric feeding device for an automatic sewing apparatus in which only a work fabric holding frame needs to be exchanged for another work fabric holding frame to accommodate different sizes of work fabric.

To achieve the above and other objects, and to overcome the shortcomings discussed above, a work fabric feeding device according to the present invention for use with an automatic sewing apparatus which includes a sewing machine having an arm extending in a first direction and a table which extends over a moving area of a work fabric to be sewn by the sewing machine comprises: guide means extending in a second direction perpendicular to the first direction; supporting means for movably supporting the guide means for movement in the first direction; first moving means for moving the guide means in the first direction; a first movable frame movably supported for movement in the second direction by the guide means; a second movable frame movably supported for movement in the second direction by the guide means; a second moving means to which the first movable frame and second movable frame are adjustably attached for movement in the second direction, the second moving means moving the first movable frame and the second movable frame along the guide means in the second direction; a work fabric holding frame capable of being placed on the table for holding a work fabric; first lifting means, connected to the first movable frame and detachably connected to the work fabric holding frame, for lifting the work fabric holding frame; and second lifting means, connected to the second movable frame and detachably connected to the work fabric holding frame, for lifting the work fabric holding frame.

In the work fabric feeding device according to the present invention, a work fabric is set on the table when the work fabric holding frame is lifted by the first lifting means and the second lifting means. Next, the work fabric holding frame is lowered by the first lifting means and the second lifting means, so that the work fabric is held by the work fabric holding frame. The work fabric holding frame is moved in the first direction as the guide means is moved by the first moving means. The work fabric holding frame is moved in the second direction as the first movable frame and the second movable frame are moved by the second moving means.

When the work fabric holding frame is exchanged for another work fabric holding frame in accordance with the size of a work fabric, the work fabric holding frame is detached from the first lifting means and the second lifting means. Then, the positions where the first movable frame and the second movable frame are fixed to the second moving device are altered, respectively, based on the size of another work fabric holding frame which is to be used to hold the next work fabric. Then, the first lifting means and the second lifting means are connected to the newly installed work fabric holding frame.

As described above, in the work fabric feeding device for an automatic sewing apparatus according to the present invention, it is possible to replace only the work fabric holding frame with another work fabric holding frame without difficulty in accordance with the size of a work fabric, and without replacing the lifting mechanisms which lift and lower the work fabric holding frame.

BRIEF DESCRIPTION OF THE DRAWINGS

A preferred embodiment of the present invention will be described in detail with reference to the following figures wherein.

DETAILED DESCRIPTION OF THE PREFERRED EMBODIMENTS

Figure 1:
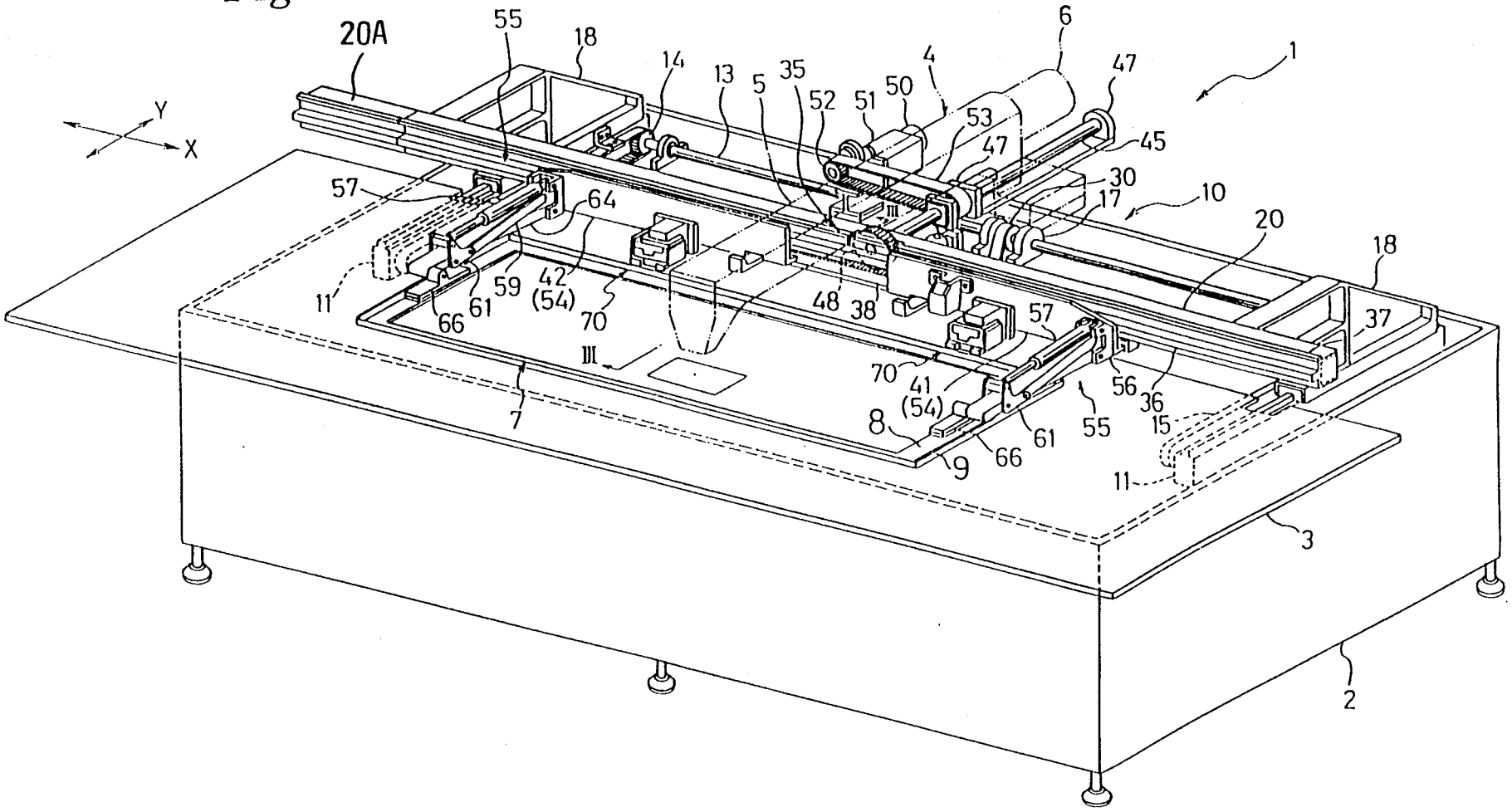
FIG. 1 is a perspective view of an automatic sewing apparatus according to a preferred embodiment of the present invention.
Figure 2:
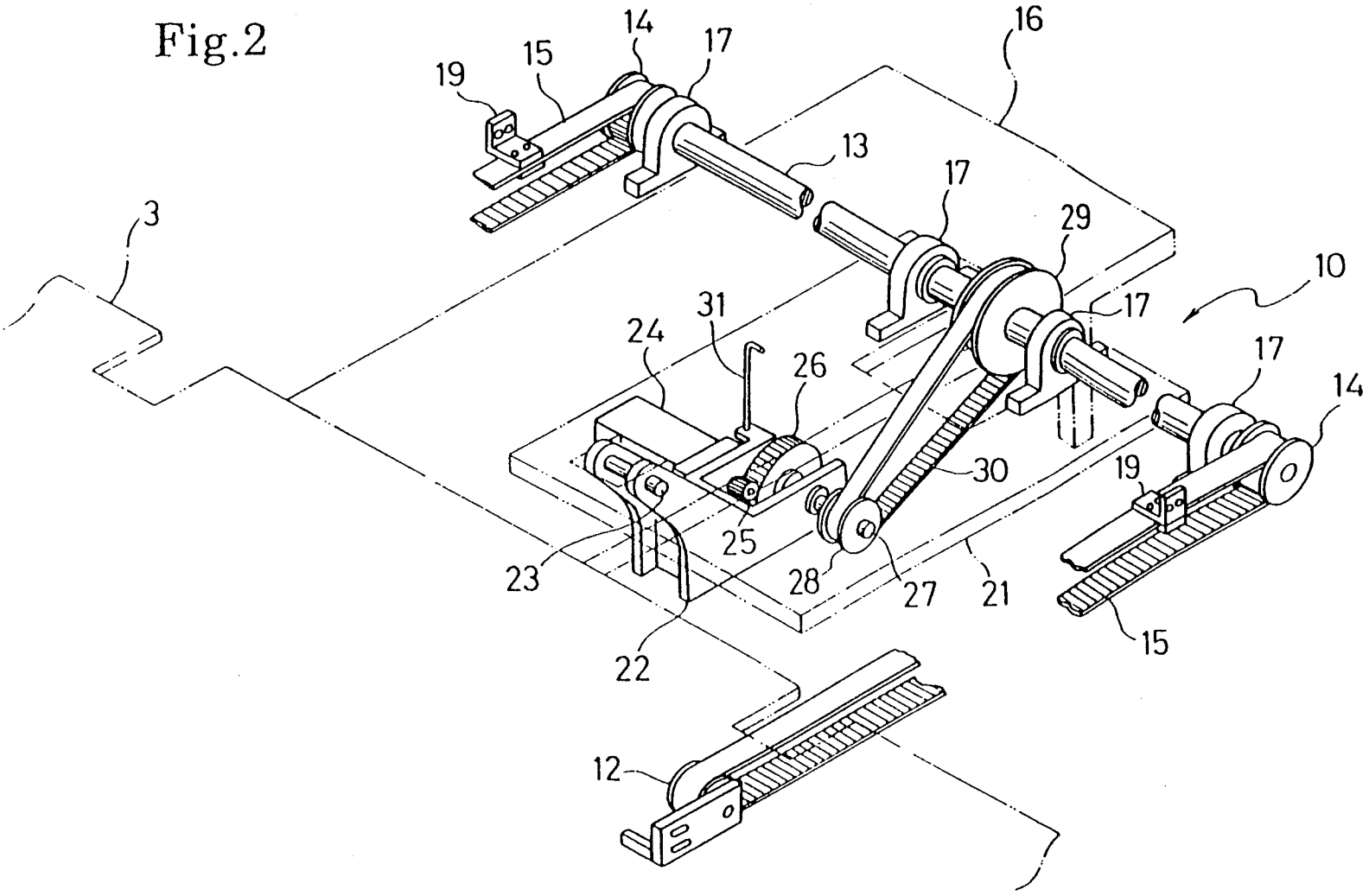
FIG. 2 is a perspective view, partially broken away, of a Y-direction driving mechanism in the work fabric feeding device of FIG. 1.

There will now be described a preferred embodiment of the present invention applied to a work fabric feeding device 1 for a large industrial automatic sewing apparatus. Referring to FIGS. 1 and 2, a working table 3 upon which a work fabric holding frame 7 can be placed is provided on a base 2 of the work fabric feeding device 1 for the large automatic sewing apparatus. A sewing machine 4 is supported at its rear end portion to a rear end portion of the base 2. An arm 5 of the sewing machine 4 is provided above the table 3 and extends toward a front side of the base 2. A sewing machine motor 6 for driving a stitch forming mechanism provided in the sewing machine 4 is mounted on the sewing machine 4.

With reference to FIGS. 1 and 2, there will first be described a Y-direction driving mechanism 10 for moving the work fabric holding frame 7 in a front or rear direction (Y-direction). Work fabric holding frame 7 includes an upper presser member 8 and a lower base member 9 between which a work fabric is held. A pair of right and left guide rails 11 extending in the Y-direction are provided just under the table 3 near a right end portion and near a left end portion of the base 2, respectively. A pair of right and left pulleys 12 are rotatably supported to front end portions of the right and left guide rails 11, respectively. A Y-direction driving shaft 13 extending in a lateral direction (X-direction) is provided at the rear end portion of the base 2. A pair of right and left pulleys 14 are fixed to opposite ends of the Y-direction driving shaft 13. A pair of right and left timing belts 15 are wound around the right pulleys 12 and 14 and around the left pulleys 12 and 14, respectively. A first supporting plate 16 is provided behind the table 3. The Y-direction driving shaft 13 is rotatably supported by a plurality of bearings 17 mounted on the first supporting plate 16. A pair of right and left supporting frames 18 are laid on the right and left guide rails 11 so as to be movable in the Y-direction, respectively. The right and left supporting frames 18 are connected to the right and left timing belts 15, respectively, through a pair of right and left fixing members 19 which are opposed to each other. A movable beam 20 extending in the X-direction is provided above the table 3. The movable beam 20 is fixed at its right and left portions to the right and left supporting frames 18, respectively.

As shown in FIG. 2, a second supporting plate 21 is provided under the first supporting plate 16 behind the table 3. A swing frame 22 is pivotally supported at its upper end portion to the second supporting plate 21 by means of a pin 23. A Y-direction driving stepping motor 24 is mounted on the swing frame 22. A driving gear 25 is fixed on a driving shaft of the motor 24. The driving gear 25 meshes with a driven gear 26 fixed on a rotating shaft 27 rotatably supported to the swing frame 22. A small-diameter pulley 28 is also fixed on the rotating shaft 27, and a large-diameter pulley 29 is fixed on the Y-direction driving shaft 13. A timing belt 30 is wound around the small-diameter pulley 28 and the large-diameter pulley 29. A tension of the timing belt 30 can be adjusted by a tension adjusting rod 31. Accordingly, when the stepping motor 24 is driven, the right and left supporting frames 18 are synchronously moved in the Y-direction through the driving gear 25, the driven gear 26, the small-diameter pulley 28, the timing belt 30, the large-diameter pulley 29, the Y-direction driving shaft 13, the right and left timing belts 15 and the right and left fixing members 19. As a result, the movable beam 20 fixed to the right and left supporting frames 18 (which are fixed to timing belts 15 by fixing members 19) is moved in the Y-direction.

Next, with reference to FIGS. 1 and 3, there will be described an X-direction driving mechanism 35 for moving the work fabric holding frame 7 in the X-direction. A guide rail 36 is fixed to a front surface of the movable beam 20 at a vertically intermediate position thereof and extends the entire length of the movable beam 20. An auxiliary guide rail 37 is fixed to an upper surface of the movable beam 20 at a front end thereof in parallel relationship to the guide rail 36. A rack member 38 formed with a rack (teeth) on an upper surface thereof is provided just under the movable beam 20 in parallel relationship thereto. A plurality of flanged rollers 40 are rotatably mounted to a bracket 39 which is attached to and extends downwardly from a lower surface of the movable beam 20. Thus, the rack member 38 is supported by the flanged rollers 40 so as to be movable in the X-direction relative to the movable beam 20.

A movable frame 54 consisting of a first movable frame 41 and a second movable frame 42 both having a substantially L-shaped configuration in side view is provided in front of the movable beam 20 and the rack member 38 so as to extend in parallel relationship to the movable beam 20. The first and second movable frames 41 and 42 are fixed at their lower end portions to the rack member 38 by screws 95 at a predetermined distance from each other. The fixed positions of the first and second movable frames 41, 42 to the rack member 38 can be adjusted so as to vary the distance between movable frames 41 and 42. Accordingly, screws 95 function as first and second fixing means for fixing the first and second movable frames 41 and 42, respectively, to rack member 38 so that a fixed position of the first and second movable frames 41 and 42 is changeable in the X-direction. A pair of guide blocks 43 are fixed to the rear surfaces of the first and second movable frames 41 and 42, respectively, and are slidably engaged with the guide rail 36. A plurality of brackets 90 are fixed to the upper ends of the first and second movable frames 41 and 42, respectively, and a flanged roller 44 for engaging the auxiliary guide rail 37 is rotatably mounted on the lower surface of each bracket 90.

Figure 3:
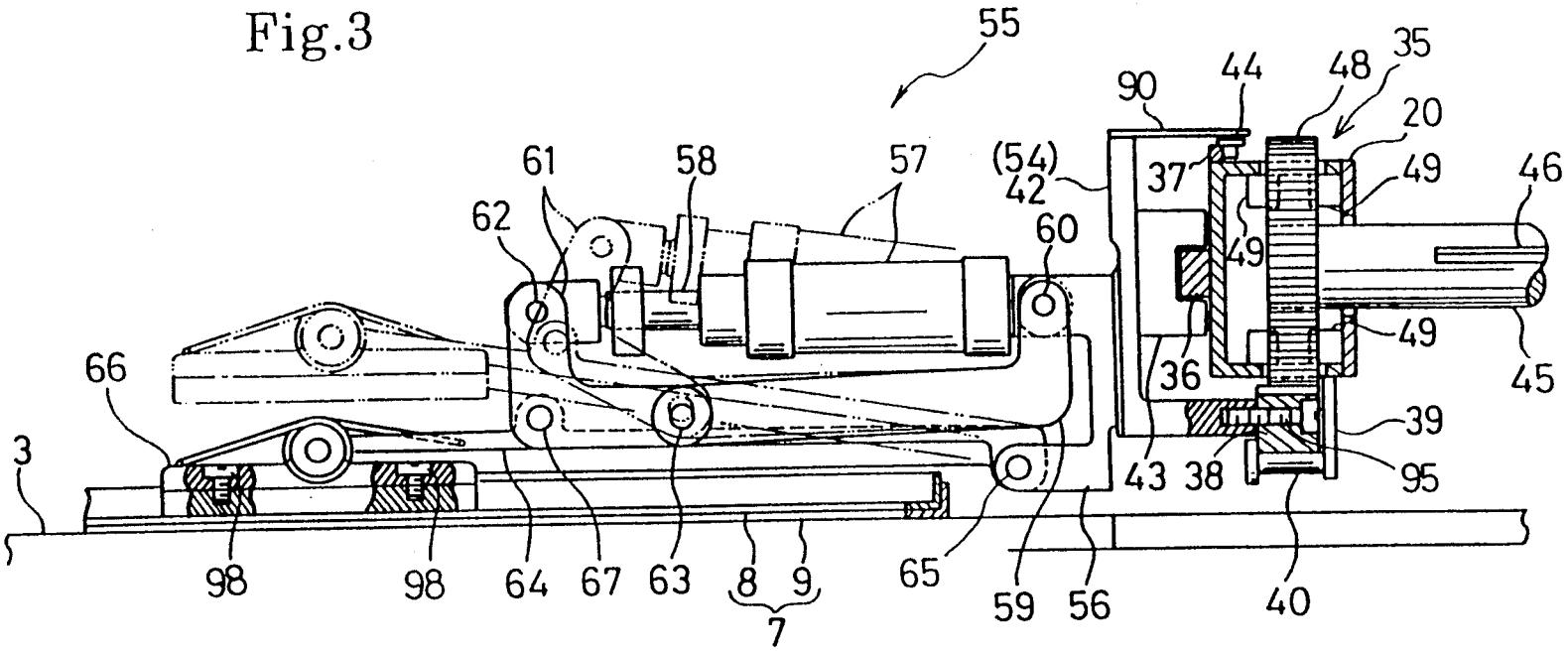
FIG. 3 is a cross sectional view taken along the line III—III in FIG. 1.

As shown in FIGS. 1 and 3, an X-direction driving shaft 45 extending in the Y-direction is provided at a substantially central position of the movable beam 20 with respect to the X-direction. The X-direction driving shaft 45 is supported by a plurality of bearings 47 fixed on the base 2 so as to be rotatable and movable in the Y-direction. A front end portion of the X-direction driving shaft 45 is positioned in the movable beam 20, and a driving pinion 48 which meshes with the teeth of the rack member 38 is fixed to the front end portion of the X-direction driving shaft 45. Two pairs of movement restriction rollers 49 are rotatably mounted on the inside surface of the movable beam 20 so as to abut against front and rear surfaces of the driving pinion 48. Accordingly, the X-direction driving shaft 45 can be moved in the Y-direction so as to maintain a predetermined positional relationship with the rack member 38 in synchronism with the movement of the movable beam 20 in the Y-direction.

The X-direction driving shaft 45 is formed on its outer surface with a key way 46 extending axially over the length of the driving shaft 45. A driven pulley (not shown) having a key engaged with the key way 46 is provided just in front of the foremost bearing 47, and is mounted on the X-direction driving shaft 45 so as to be slidable thereon and so as to transmit a torque to the driving shaft 45. On the left side of the X-direction driving shaft 45, an X-direction driving stepping motor 50 for driving the X-direction driving shaft 45 and a gear box 51 for reducing a rotational speed of the motor 50 are fixed to the base 2. A driving pulley 52 is fixed on a gear shaft (not shown) which is attached to a final gear of the gear box 51. A timing belt 53 is wound around the driving pulley 52 and the driven pulley mounted on the X-direction driving shaft 45. Accordingly, when the X-direction driving stepping motor 50 is driven, the driving pinion 48 is rotationally driven through the gear box 51, the driving pulley 52, the timing belt 53, the driven pulley and the X-direction driving shaft 45. The rotation of the driving pinion 48 causes rightward or leftward movement of the rack member 38, the first movable frame 41 and the second movable frame 42 as a unit along the movable beam 20 while being guided by the guide rail 36 and the auxiliary guide rail 37.

Next, with reference to FIGS. 1 and 3, there will be described a pair of right and left frame lifting mechanisms 55 for vertically moving the upper presser member 8 of the work fabric holding frame 7. The right and left frame lifting mechanisms 55 are mounted on a right end portion of the first movable frame 41 and a left end portion of the second movable frame 42, respectively. Since both the frame lifting mechanisms 55 have the same structure, the following description will be directed solely to the left frame lifting mechanism 55 mounted on the second movable frame 42.

A mounting member 56 having a U-shaped configuration in both plan and side views is fixed to the front surface of the second movable frame 42. An air cylinder 57 is pivotally supported at its base end through a pin 60 to an upper end portion of the mounting member 56. Further, a first pivotal member 59 having an L-shaped configuration in side view is also pivotally supported at its rear end through the pin 60 to the upper end portion of the mounting member 56. A piston rod 58 of the air cylinder 57 is pivotally supported at its front end through a pin 62 to an upper end of a connecting member 61 having an L-shaped configuration in side view. A rear end of the connecting member 61 is pivotally connected through a pin 63 to a front end of the first pivotal member 59. A second pivotal member 64 for lifting the upper presser member 8 is pivotally supported at its rear end through a pin 65 to a lower end portion of the mounting member 56. A front end of the second pivotal member 64 is pivotally connected to a mounting plate 66. The mounting plate 66 is detachably fixed to the upper presser member 8 by a pair of screws 98. The second pivotal member 64 is also pivotally supported at an intermediate position thereof through a pin 67 to an angular portion of the L-shaped connecting member 61. Accordingly, when the air cylinder 57 is driven to retract the piston rod 58, the connecting member 61 is rotated clockwise as viewed in FIG. 3, and the front end portion of the second pivotal member 64 is therefore lifted. As a result, the mounting plate 66 and the upper presser member 8 are lifted from a work fabric holding position shown by solid line to a work fabric releasing position shown by phantom line.

Figure 4:
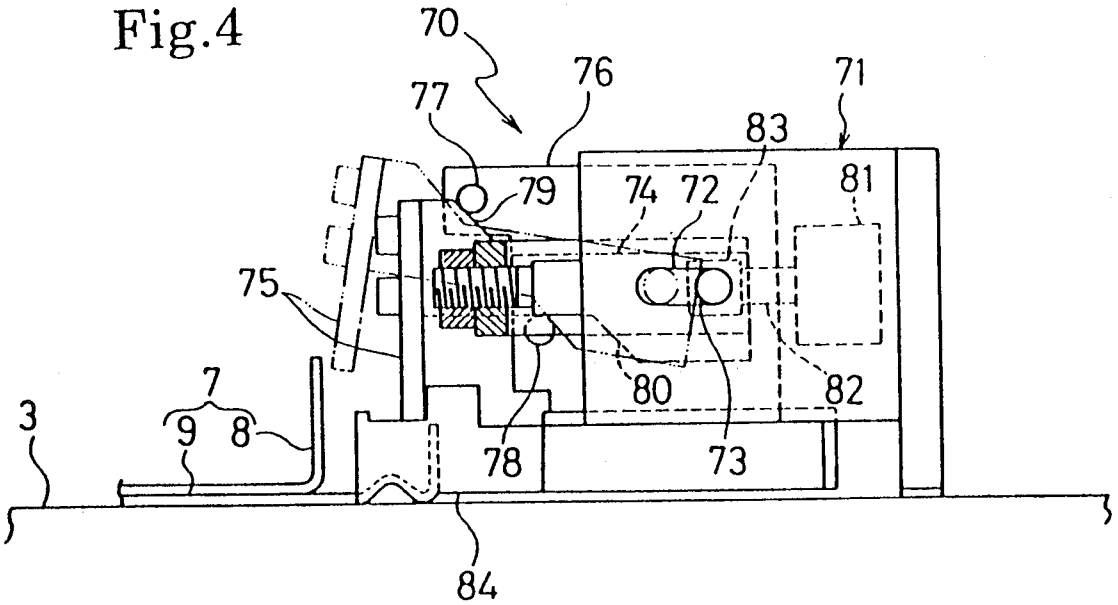
FIG. 4 is a side view of a clamping mechanism for clamping a work fabric holding frame.

Next, with reference to FIGS. 1 and 4, there will be described a pair of right and left frame clamping mechanisms 70 for detachably clamping the lower base member 9 of the work fabric holding frame 7 to the first and second movable frames 41 and 42, respectively. The right and left frame clamping mechanisms 70 are mounted on the front surfaces of both the movable frames 41 and 42, respectively. Since both the frame clamping mechanisms 70 have the same structure, the following description will be directed solely to the left frame clamping mechanism 70 mounted on the second movable frame 42.

A supporting case 71 is mounted on the second movable frame 42. Right and left walls of the supporting case 71 are formed with a pair of elongated holes 72, respectively. A pair of right and left cam members 74 are fixed at their rear ends to a pin 73 which is inserted through the elongated holes 72. A clamping pawl 75 is mounted on the front ends of the cam members 74. A pair of right and left fixed plates 76 are provided just inside the right and left walls of the supporting case 71. An upper operating pin 77 and a lower operating pin 78 are fixed to the fixed plates 76. The upper operating pin 77 is engageable with first inclined surfaces 79 of the cam members 74, and the lower operating pin 78 is engageable with second inclined surfaces 80 of the cam members 74. An air cylinder 81 is provided in the supporting case 71. A piston rod 82 of the air cylinder 81 is connected at its front end to a block 83 which is fixed to the pin 73. Accordingly, when the air cylinder 81 is driven to advance the piston rod 82, the cam members 74 are first moved to the front side by a small distance, so that the clamping pawl 75 moves forwardly (to the left in FIG. 4). Forward movement of clamping pawl 75 releases a clamping member 84, fixed to a rear end of the lower base member 9, from a clamping position shown by solid line, thereby releasing a clamping condition of the lower base member 9. Then, the cam members 74 are upwardly rotated by the engagement of the second inclined surfaces 80 with the lower operating pin 78. In contrast, when the piston rod 82 is retracted, the cam members 74 are downwardly rotated by the engagement of the first inclined surfaces 79 with the upper operating pin 77, and the clamping pawl 75 comes into engagement with the clamping member 84. Then, the clamping member 84 is moved to the clamping position by the rearward movement of the cam members 74, thereby clamping the lower base member 9.

According to the present invention, movable beam 20 functions as a guide means for guiding the movement of a work fabric to be sewn by sewing machine 4. Guide rails 11 and frames 18 function as supporting means for movably supporting movable beam 20 in the Y-direction. Driving mechanism 10 functions as first moving means for moving beam 20 in the Y-direction. Driving mechanism 35 functions as second moving means, to which the first and second movable frames 41 and 42 are adjustably attached for movement in the X-direction, for moving the first and second movable frames 41 and 42 in the X-direction. Lifting mechanisms 55 function as lifting means, connected to the first and second movable frames 41 and 42, for lifting work fabric holding frame 7. Screws 98 function as connecting means for detachably connecting lifting mechanisms 55 to work fabric holding frame 7. While specific structural examples have been provided for possible constructions of the various mechanisms and means described above, these examples merely describe a preferred embodiment of the invention and are meant to be illustrative, not limiting.

In the work fabric feeding device 1 for an automatic sewing apparatus as mentioned above, the movable beam 20 supporting the movable frame 54 is located above the upper surface of the table 3. The rack member 38 fixed to the movable frame 54 for supporting the work fabric holding frame 7 is moved in the X-direction by the driving pinion 48 of the X-direction driving mechanism 35. The movable frame 54 is divided into the first movable frame 41 and the second movable frame 42, and each of the movable frames 41 and 42 is provided with a frame lifting mechanism 55 and a frame clamping mechanism 70. The first and second movable frames 41, 42 are removably fixed to the rack member 38 in a manner which permits the fixed positions of the first and second movable frames 41, 42 to the rack member 38 to be varied, respectively. Each of the frame lifting mechanisms 55 is detachably connected to the upper presser member 8 of a corresponding work fabric holding frame 7 through the mounting plate 66.

Accordingly, when an operator exchanges the work fabric holding frame 7 for a different sized work fabric holding frame 7 according to the size of a work fabric to be sewn, the operator detaches the upper presser member 8 from its corresponding frame lifting mechanisms 55, detaches lower base member 9 from clamping mechanisms 70, adjusts the fixing positions of the first and second movable frames 41, 42 to the rack member 38, connects an upper presser member 8 of another work fabric holding frame 7 to the frame lifting mechanisms 55, and connects a lower base member 9 of another work fabric holding frame 7 to clamping mechanisms 70. Therefore, only the work fabric holding frame 7 needs to be exchanged for another work fabric holding frame 7 without exchanging the frame lifting mechanisms 55 when sewing different sized work fabrics.

Moreover, no obstacles exist on the extension of the opposite ends of the movable beam 20 and in a moving area of the rack member 38 in the X-direction. Therefore, by replacing the work fabric holding frame 7 with a larger one, and shifting the mounting positions of the movable frames 41 and 42 to the rack member 38 to more outside positions in the X-direction, a moving distance of the work fabric holding frame 7, that is, a sewing area can be expanded in the X-direction easily and inexpensively as required. Additionally, an extension 20A can be attached to one or both sides of beam 20 to extend movement in the X-direction even further. Similarly, rack member 38 can also be extended. Beam 20 and rack member 38 can be extended because they are located above table 3 where there are no obstructions.

Further, as the X-direction driving mechanism 35 and the Y-direction driving mechanism 10 are located on the side of a pedestal of the sewing machine 4, the automatic sewing apparatus can be made compact, and the operability can be improved.

Additionally, frames other than the frame 7 illustrated in the drawings can be used with the feeding device of the present invention. For example, a single frame similar to upper presser member 8, but with teeth on its lower surface can be used. This single frame is attached to lifting mechanisms 55 and the teeth on the lower surface of the single frame would grip the work fabric.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A work fabric feeding device comprising:

a guide means for guiding a work fabric to be sewn, said guide means extending in a first direction;

a first movable frame movably supported by said guide means for movement in the first direction;

a second movable frame movably supported by said guide means for movement in the first direction;

moving means for moving said first and second movable frame along said guide means in the first direction, said first and second movable frames being adjustably attached to said moving means, the attachment of said first and second movable frames to said moving means being adjustable in the first direction; and lifting means, connected to said first and second movable frames, for lifting a single work fabric holding frame having an open central portion surrounded by a peripheral frame portion, said lifting means including connecting means for detachably connecting said lifting means to the single work fabric holding frame.

2. The device of claim 1, wherein said lifting means includes first and second lifting mechanisms respectively attached to said first and second movable frames, a separate connecting means being provided on each of said first and second lifting mechanisms.

3. The device of claim 1, wherein said lifting means comprises a lifting mechanism having a first L-shaped pivotal member pivotally attached at one end to a mounting member of one of said first and second movable frames, an L-shaped connecting member pivotally attached at one end to a second end of said first L-shaped pivotal member, an actuator having a shaft which is movable between an extended position and a retracted position, said actuator being pivotally attached at one end to the mounting member of a same one of said first and second movable frames as said one end of said first L-shaped pivotal member, and being pivotally attached at a second end to a second end of said L-shaped connecting member, and a second pivotal member, pivotally attached at one end to the mounting member of the same one of said first and second movable frames, pivotally attached at an intermediate portion thereof to a bend portion of said L-shaped connecting member, and having said connecting means at a second end thereof, wherein said connecting means is lifted when said actuator shaft is retracted, and lowered when said actuator shaft is extended.

4. The device of claim 3, wherein said lifting means includes first and second lifting mechanisms respectively attached to respective mounting members of said first and second movable frames, a separate connecting means being provided on each of said first and second lifting mechanisms.

5. The device of claim 1, wherein said moving means includes:

a rack member extending in the first direction, movably attached to said guide means for movement in the first direction, and having teeth thereon; and a driving pinion having teeth on a circumference thereof which are engaged with the teeth on said rack member; and wherein said first and second movable frames are adjustably attached to said rack member.

6. The device of claim 1, wherein said guide means is a beam which extends in said first direction.

7. The device of claim 1, wherein said guide means is movable in a second direction perpendicular to said first direction, said device further comprising:

supporting means for movably supporting said guide means so that said guide means can be moved in the second direction; and second moving means for moving said guide means in the second direction.

8. The device of claim 7, wherein said supporting means includes a pair of guide rails extending in the second direction upon which said guide means is movably mounted at end portions thereof.

9. The device of claim 1, wherein the single work fabric holding frame to which the device is attachable includes an upper pressure member and a lower base member, the upper presser member and the lower base member each having respective open central portions surrounded by peripheral frame portions, and being engageable with each other to clamp a work fabric therebetween, said connecting means being detachably connectable to the upper presser member, and further comprising;

second connecting means for detachably connecting the lower base member of the single frame to at least one of said first and second movable frame.

10. The device of claim 9, wherein said second connecting means includes a pair of second connecting mechanisms, each being attached to a corresponding one of said first and second movable frames.

11. The device of claim 9, wherein said second connecting means comprises a second connecting mechanism having:

a supporting case including a pair of parallel walls extending perpendicularly outward from one of said first and second movable frames, each of said parallel walls having a slot therein which is elongated in a second direction perpendicular to the first direction;

a cam member extending outwardly from said supporting case in said second direction, said cam member having a pin extending outwardly from sides thereof in said first direction and through both of said slots, said pin being attached to one end of said cam member, a clamping pawl at a second end of said cam member for engaging a clamping member on the lower base member of said single work fabric holding frame, a first inclined surface on an upper portion of said cam member and a second inclined surface on a lower portion of said cam member;

an actuator in said supporting case having a shaft which is movable between an extended and a retracted position, said shaft being attached to said one end of said cam member; and a plate fixed to said supporting case and extending in the second direction, said plate having an upper operating pin extending therefrom in the first direction which is engageable with said first inclined surface and a lower operating pin extending therefrom in the first direction which is engageable with said second inclined surface, wherein said first inclined surface engages said upper operating pin when said shaft is retracted to move said clamping pawl to a clamping position, and said second inclined surface engages said lower operating pin when said shaft is extended to move said clamping pawl to a released position.

12. The device of claim 11, wherein said second connecting means includes a pair of second connecting mechanisms, each being attached to a corresponding one of said first and second movable frames.

13. A work fabric feeding device for an automatic sewing apparatus which includes a sewing machine having an arm extending in a first direction and a table which extends over a moving area of a work fabric to be sewn by said sewing machine, said work fabric feeding device comprising:

a guide member extending in a second direction perpendicular to the first direction;

supporting means for movably supporting said guide member so that said guide member can be moved in the first direction;

first moving means for moving said guide member in the first direction;

a first movable frame movably supported by said guide member for movement in the second direction;

a second movable frame movably supported by said guide member for movement in the second direction;

second moving means to which said first movable frame and second movable frame are adjustably attached, the attachment of said first and second movable frames to said second moving means being adjustable in the second direction, said second moving means for moving said first movable frame and said second movable frame along said guide member in the second direction;

a single work fabric holding frame capable of being placed on the table for holding the work fabric, said single work fabric holding frame having an open central portion surrounded by a peripheral frame portion;

first lifting means connected to said first movable frame and detachably connected to said single work fabric holding frame, said first lifting means for lifting said work fabric holding frame; and second lifting means connected to said second movable frame and detachably connected to said single work fabric holding frame, said second lifting means for lifting said single work fabric holding frame.

14. The device of claim 13, wherein each of said first and second lifting means comprises a lifting mechanism having a first L-shaped pivotal member pivotally attached at one end to a mounting member of a corresponding one of said first and second movable frames, an L-shaped connecting member pivotally attached at one end to a second end of said first L-shaped pivotal member, an actuator having a shaft which is movable between an extended position and a retracted position, said actuator being pivotally attached at one end to the mounting member of a same one of said first and second movable frames as said one end of said first L-shaped pivotal member, and being pivotally attached at a second end to a second end of said L-shaped connecting member, and a second pivotal member, pivotally attached at one end to the mounting member of the same one of said first and second movable frames, pivotally attached at an intermediate portion thereof to a bend portion of said L-shaped connecting member, and being detachably connected to said single work fabric holding frame at a second end thereof, wherein said single work fabric holding frame is lifted when said actuator shaft is retracted, and lowered when said actuator shaft is extended.

15. The device of claim 13, wherein said second moving means includes:

a rack member extending in the second direction, movably attached to said guide member for movement in the second direction, and having teeth thereon; and a driving pinion having teeth on a circumference thereof which are engaged with the teeth on said rack member; and wherein said first and second movable frames are adjustably attached to said rack member.

16. The device of claim 13, wherein said supporting means includes a pair of guide rails extending in the first direction upon which said guide member is movably mounted.

17. The device of claim 13, wherein the single work fabric holding frame includes an upper presser member and a lower base member, the upper presser member and the lower base member each having respective open central portions surrounded by peripheral frame portions, and being engageable with each other to clamp the work fabric therebetween, said first and second lifting means being detachably connected to the upper presser member, and further comprising:

first and second connecting means for detachably connecting the lower base member of the single frame to said first and second movable frames, respectively.

18. The device of claim 17, wherein said first and second connecting means comprises a second connecting mechanism having:

a supporting case including a pair of parallel walls extending perpendicularly outward from a corresponding one of said first and second movable frames, each of said parallel walls having a slot therein which is elongated in the first direction;

a cam member extending outwardly from said supporting case in said first direction, said cam member having a pin extending outwardly from sides thereof in said second direction and through both of said slots, said pin being attached to one end of said cam member, a clamping pawl at a second end of said cam member for engaging a clamping member on the lower base member of said single work fabric holding frame, a first inclined surface on an upper portion of said cam member and a second inclined surface on a lower portion of said cam member;

an actuator in said supporting case having a shaft which is movable between an extended position and a retracted position, said shaft being attached to said one end of said cam member; and a plate fixed to said supporting case and extending in the first direction, said plate having an upper operating pin extending therefrom in the second direction which is engageable with said first inclined surface and a lower operating pin extending therefrom in the second direction which is engageable with said second inclined surface, wherein said first inclined surface engages said upper operating pin when said shaft is retracted to move said clamping pawl to a clamping position, and said second inclined surface engages said lower operating pin when said shaft is extended to move said clamping pawl to a released position.

19. A work fabric feeding device for an automatic sewing apparatus which includes a sewing machine having an arm extending in a first direction and a table which extends over a moving area of a work fabric to be sewn by said sewing machine, said work fabric feeding device comprising:

a beam extending in a second direction perpendicular to the first direction;

supporting means for movably supporting said beam so that said beam can be moved in the first direction, said supporting means including a pair of guide rails extending in the first direction upon which said beam is movably mounted;

moving means for moving said beam in the first direction;

a rack member movably supported by said beam for movement in the second direction, said rack member extending in the second direction;

a first movable frame movably supported by said beam for movement in the second direction;

first attaching means for adjustably attaching said first movable frame to said rack member so that a fixed position of said first movable frame to said rack member is variable along the second direction;

a second movable frame movable supported by said beam for movement in the second direction;

second attaching means for adjustably attaching said second movable frame to said rack member so that a fixed position of said second movable frame to said rack member is variable along the second direction;

a driving pinion, attached to said rack member, for moving said rack member in the second direction;

a single work fabric holding frame capable of being mounted on the table, for holding the work fabric, said single work fabric holding frame having an open central portion surrounded by a peripheral frame portion;

a first lifting mechanism mounted on said first movable frame;

first connecting means for detachably connecting said first lifting mechanism to said single work fabric holding frame;

a second lifting mechanism mounted on said second movable frame, for lifting said work fabric holding frame; and second connecting means for detachably connecting said second lifting means to said single work fabric holding frame.

20. The device of claim 19, wherein said first and second lifting mechanisms each include a first L-shaped pivotal member pivotally attached at one end to a mounting member of a corresponding one of said first and second movable frames, an L-shaped connecting member pivotally attached at one end to a second end of said first L-shaped pivotal member, an actuator having a shaft which is movable between an extended position and a retracted position, said actuator being pivotally attached at one end to the mounting member of a same one of said first and second movable frames as said one end of said first L-shaped pivotal member, and being pivotally attached at a second end to a second end of said L-shaped connecting member, and a second pivotal member, pivotally attached at one end to the mounting member of the same one of said first and second movable frames, pivotally attached at an intermediate portion thereof to a bend portion of said L-shaped connecting member, and having a corresponding one of said first and second connecting means at a second end thereof, wherein said single work fabric holding frame is lifted when said actuator shaft is retracted, and lowered when said actuator shaft is extended.

21. The device of claim 19, wherein the single work fabric holding frame includes an upper presser member and a lower base member, the upper presser member and the lower base member each having respective open central portions surrounded by peripheral frame portions, and being engageable with each other to clamp a work fabric therebetween, said first and second connecting means being detachably connected to the upper presser member, and further comprising;

lower base member connecting means for detachably connecting the lower base member of the single frame to at least one of said first and second movable frames.

22. The device of claim 21, wherein said lower base member connecting means comprises a lower base member connecting mechanism having:

a supporting case including a pair of parallel walls extending perpendicularly outward from one of said first and second movable frames, each of said parallel walls having a slot therein which is elongated in the first direction;

a cam member extending outwardly from said supporting case in said first direction, said cam member having a pin extending outwardly from sides thereof in said second direction and through both of said slots, said pin being attached to one end of said cam member, a clamping pawl at a second end of said cam member for engaging a clamping member on the lower base member of said single work fabric holding frame, a first inclined surface on an upper portion of said cam member and a second inclined surface on a lower portion of said cam member;

an actuator in said supporting case having a shaft which is movable between an extended and a retracted position, said shaft being attached to said one end of said cam member; and a plate fixed to said supporting case and extending in the first direction, said plate having an upper operating pin extending therefrom in the second direction which is engageable with said first inclined surface and a lower operating pin extending therefrom in the second direction which is engageable with said second inclined surface, wherein said first inclined surface engages said upper operating pin when said shaft is retracted to move said clamping pawl to a clamping position, and said second inclined surface engages said lower operating pin when said shaft is extended to move said clamping pawl to a released position.

* * * * *